US009044639B2

(12) United States Patent
Chia et al.

(10) Patent No.: US 9,044,639 B2
(45) Date of Patent: Jun. 2, 2015

(54) SUPPORT FRAME FOR EXERCISE APPARATUS

(71) Applicant: REXON INDUSTRIAL CORP., LTD., Taichung (TW)

(72) Inventors: Benjamin Chia, San Jose, CA (US); Yi-Chun Liao, Taichung (TW)

(73) Assignee: REXON INDUSTRIAL CORP., LTD., Taichung (TW)

( * ) Notice: Subject to any disclaimer, the term of this patent is extended or adjusted under 35 U.S.C. 154(b) by 291 days.

(21) Appl. No.: 13/854,450

(22) Filed: Apr. 1, 2013

(65) Prior Publication Data

US 2013/0260967 A1 Oct. 3, 2013

Related U.S. Application Data

(60) Provisional application No. 61/618,895, filed on Apr. 2, 2012.

(30) Foreign Application Priority Data

Apr. 2, 2012 (TW) ..... 101111707 A

(51) Int. Cl.
*A63B 22/06* (2006.01)
*A63B 22/00* (2006.01)
(Continued)

(52) U.S. Cl.
CPC ..... *A63B 23/0476* (2013.01); *A63B 22/0015* (2013.01); *A63B 22/0046* (2013.01); *A63B 22/0605* (2013.01); *A63B 2022/0652* (2013.01); *A63B 2208/0233* (2013.01)

(58) Field of Classification Search
CPC ..... A63B 22/06; A63B 22/0046; A63B 22/0605; A63B 2208/0233; A63B 22/0015; A63B 2022/0652; A63B 22/0048; A63B 22/0087; A63B 22/0635; A63B 22/0062; A63B 22/0641; A63B 2022/0647; A63B 22/0664
USPC ..... 482/51–53, 57–69, 72–73, 78, 131–139
See application file for complete search history.

(56) References Cited

U.S. PATENT DOCUMENTS 2,145,940 A * 2/1939 Marlowe ..... 482/72
3,578,800 A * 5/1971 DiNepi ..... 482/57
(Continued)

FOREIGN PATENT DOCUMENTS

FR 2440753 A * 7/1980
GB 2361651 A * 10/2001
(Continued)

*Primary Examiner* — Oren Ginsberg
*Assistant Examiner* — Joshua Lee
(74) *Attorney, Agent, or Firm* — Bacon & Thomas, PLLC

(57) ABSTRACT

A support frame for an exercise apparatus includes a base, and a smoothly arched moving arm member slidably coupled to the base. The moving arm member defines a first end connected to a wheel pedal unit and an opposing second end connected to a saddle unit, such that a distance difference between the first and second ends in the vertical direction, as well as in the horizontal direction, changes subject to changing the relative position between the moving arm member and the base. Thus, by means of moving the moving arm member relative to the base, the distance difference between the first and second ends is relatively changed, causing change of the relative position between the wheel pedal unit and the saddle unit. This allows the user to select a normal upright sitting exercise mode or a recumbent sitting exercise mode.

20 Claims, 7 Drawing Sheets

(51) Int. Cl.

| | |
|---|---|
| ***A63B 21/00*** | (2006.01) |
| ***A63B 69/16*** | (2006.01) |
| ***A63B 71/00*** | (2006.01) |
| ***A63B 23/04*** | (2006.01) |

(56) References Cited

U.S. PATENT DOCUMENTS

| | | | | |
|---|---|---|---|---|
| 3,727,608 | A * | 4/1973 | Simsian | 601/146 |
| 3,910,571 | A * | 10/1975 | Stenn | 482/60 |
| 4,796,882 | A * | 1/1989 | Jiumr | 482/57 |
| 5,178,593 | A * | 1/1993 | Roberts | 482/62 |
| 5,549,527 | A * | 8/1996 | Yu | 482/57 |
| 5,782,639 | A * | 7/1998 | Beal | 434/29 |
| 5,951,447 | A * | 9/1999 | Butler | 482/111 |
| 6,001,071 | A * | 12/1999 | Butler | 601/36 |
| 6,071,215 | A | 6/2000 | Raffo et al. | |
| 6,551,219 | B1 * | 4/2003 | Brown | 482/57 |
| 6,692,411 | B1 * | 2/2004 | Stearns et al. | 482/57 |
| 6,926,645 | B1 * | 8/2005 | Stearns et al. | 482/62 |
| 7,097,598 | B2 * | 8/2006 | Lee | 482/57 |
| 7,393,308 | B1 * | 7/2008 | Huang | 482/51 |
| 7,758,475 | B2 * | 7/2010 | Goldberg | 482/62 |
| 7,819,782 | B2 * | 10/2010 | Yamazaki | 482/73 |
| 7,867,146 | B2 * | 1/2011 | Ge et al. | 482/51 |
| 8,062,190 | B2 * | 11/2011 | Pyles et al. | 482/57 |
| 8,062,192 | B1 * | 11/2011 | Arstein | 482/57 |
| 2002/0004439 | A1 * | 1/2002 | Galbraith et al. | 482/57 |
| 2002/0016236 | A1 * | 2/2002 | Stearns et al. | 482/57 |
| 2004/0259694 | A1 * | 12/2004 | Yang | 482/63 |
| 2005/0239608 | A1 * | 10/2005 | Somwong | 482/57 |
| 2008/0085819 | A1 | 4/2008 | Yang | |
| 2009/0197744 | A1 * | 8/2009 | Yamazaki | 482/57 |
| 2010/0130331 | A1 * | 5/2010 | Hu | 482/57 |
| 2012/0115695 | A1 * | 5/2012 | Watterson et al. | 482/142 |
| 2013/0130798 | A1 * | 5/2013 | Nir et al. | 463/36 |

FOREIGN PATENT DOCUMENTS

| | | | |
|---|---|---|---|
| JP | 3143723 U | * | 7/2008 |
| TW | I299668 B | | 8/2008 |

* cited by examiner

SUPPORT FRAME FOR EXERCISE APPARATUS

CROSS REFERENCE TO RELATED APPLICATION(S)

This application claims, under 35 U.S.C. §119(e), priority to U.S. Provisional Application No. 61/618,895, filed Apr. 2, 2012, which application is hereby incorporated by reference in its entirety, inclusive of the specification, claims, and drawings.

FIELD OF THE INVENTION

The present invention relates to an exercise apparatus and more particularly, to a support frame for an exercise apparatus, which allows exercises in different exercising postures.

BACKGROUND

Referring to FIGS. 1 and 2, U.S. Pat. No. 6,071,215 discloses a multi-mode exercise machine 1, which includes an exercise base station 11, a pedal unit 12 mounted to the exercise base station 11, a cycle seat 13 supported on the pedal unit 12, an arm 14 pivotally mounted to the exercise base station 11 at one side relative to the pedal unit 12. Handlebars 15 are mounted to one end of the arm 14, and a second seat 16 is slidably coupled to the arm 14. A receivable pull rope unit 17 is pivotally mounted to the pedal unit 12, and a footrest unit 18 is pivotally mounted to the other end of the arm 14. The pull rope unit 17 includes a pull rope 171 passing around a guide roller inside the pedal unit 12, and a pull bar 172 connected to one end of the pull rope 171 and disposed outside the pedal unit 12.

When the arm 14 is set in a vertical position, a user can sit on the cycle seat 13 and hold the handlebars 15 with their hands, and then operate the pedal unit 12 with their feet for performing a first exercise mode. Alternatively, when the arm 14 is set in a horizontal position, the user can sit on the second seat 16 in a recumbent posture to hold the pull bar 172 with their two hands and then place their feet in the foot rest unit 18. By means of pulling up or letting off the pull rope 171, the second seat 16 is moved along the arm 14 for performing a second exercise mode.

The aforesaid prior art multi-mode exercise machine 1 can provide both upright and recumbent exercise modes. However, it must provide two seats (the cycle seat 13 and the second seat 16), two handles (the handlebars 15 and the pull bar 172) and two foot portions (the pedal unit 12 and the foot rest unit 18). Including two versions of each of these components disadvantageously complicates the structure and operation of this prior art exercise machine 1.

SUMMARY OF THE INVENTION

The present invention has been accomplished under the circumstances in view. It is the main object of the present invention to provide a support frame for an exercise apparatus, which has a simple structure that facilitates operation, and which allows a user to easily change exercise modes.

To achieve this and other objects of the present invention, a support frame is disclosed in an exercise apparatus having a wheel pedal unit for pedaling by the legs of a user, and a saddle unit to accommodate sitting by the user. The support frame includes a base and a moving arm member that is smoothly arched and slidably coupled to the base. The moving arm member also includes a first end and an opposite second end, wherein the opposing first and second ends are respectively connected to the wheel pedal unit and the saddle unit. The elevation difference, i.e. the distance, between the first and second ends in both the vertical direction as well as the horizontal direction is changeable subject to changing the relative position between the moving arm member and the base.

In view of the above, there are numerous benefits of moving the moving arm member relative to the base to change the elevation difference between the first and second ends of the moving arm member. For example, the relative position between the wheel pedal unit and the saddle unit may be relatively changed, thus allowing the user to perform a first exercise mode in a normal upright sitting position or a second exercise mode in a recumbent sitting position.

BRIEF DESCRIPTION OF THE DRAWINGS

These and other features, aspects, and advantages of the present disclosure will become better understood with regard to the following description, appended claims, and accompanying drawings.

Figure 1:
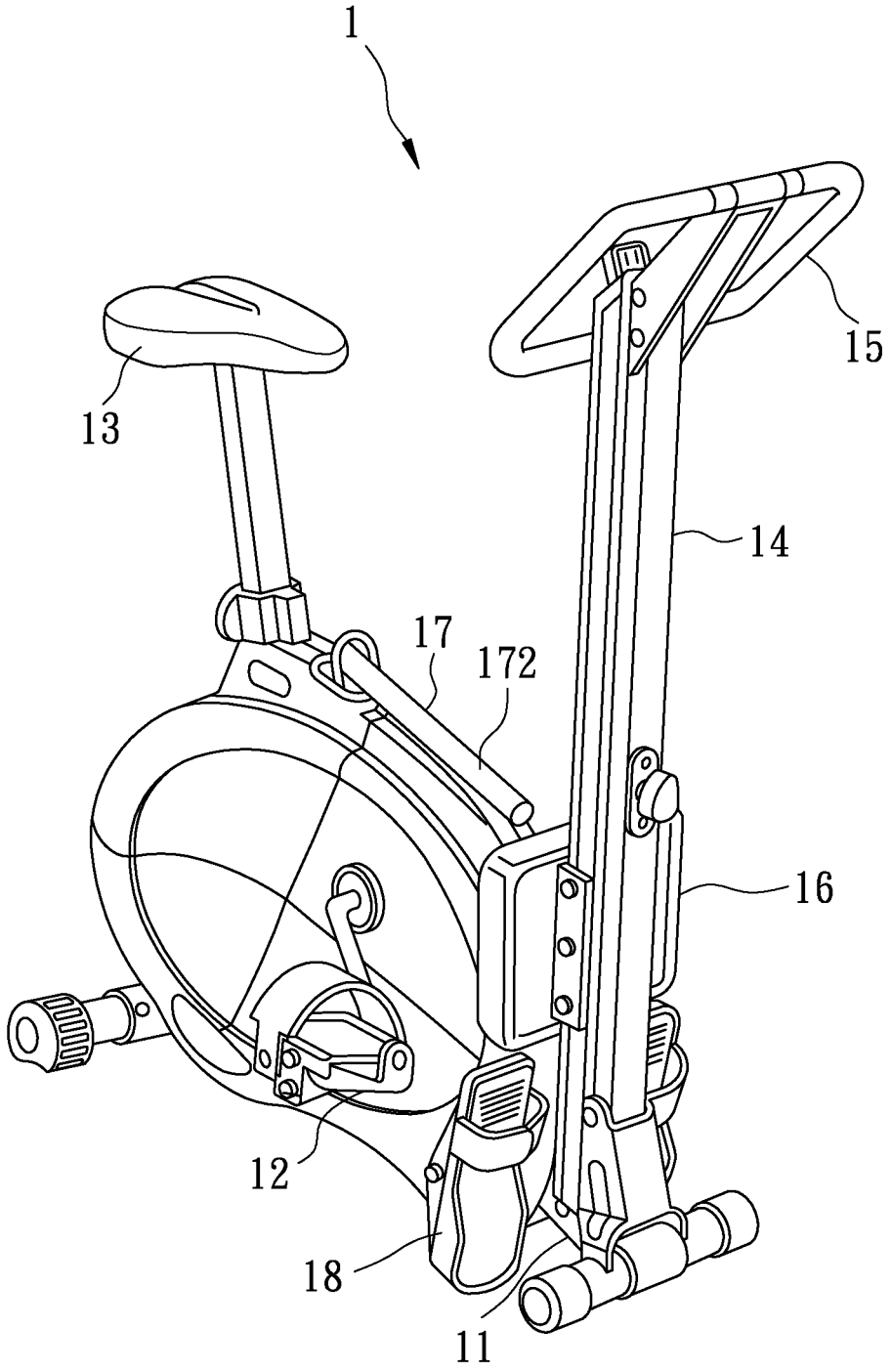
FIG. 1 PRIOR ART
FIG. 1 is a perspective view of a conventional multi-mode exercise machine.
Figure 2:
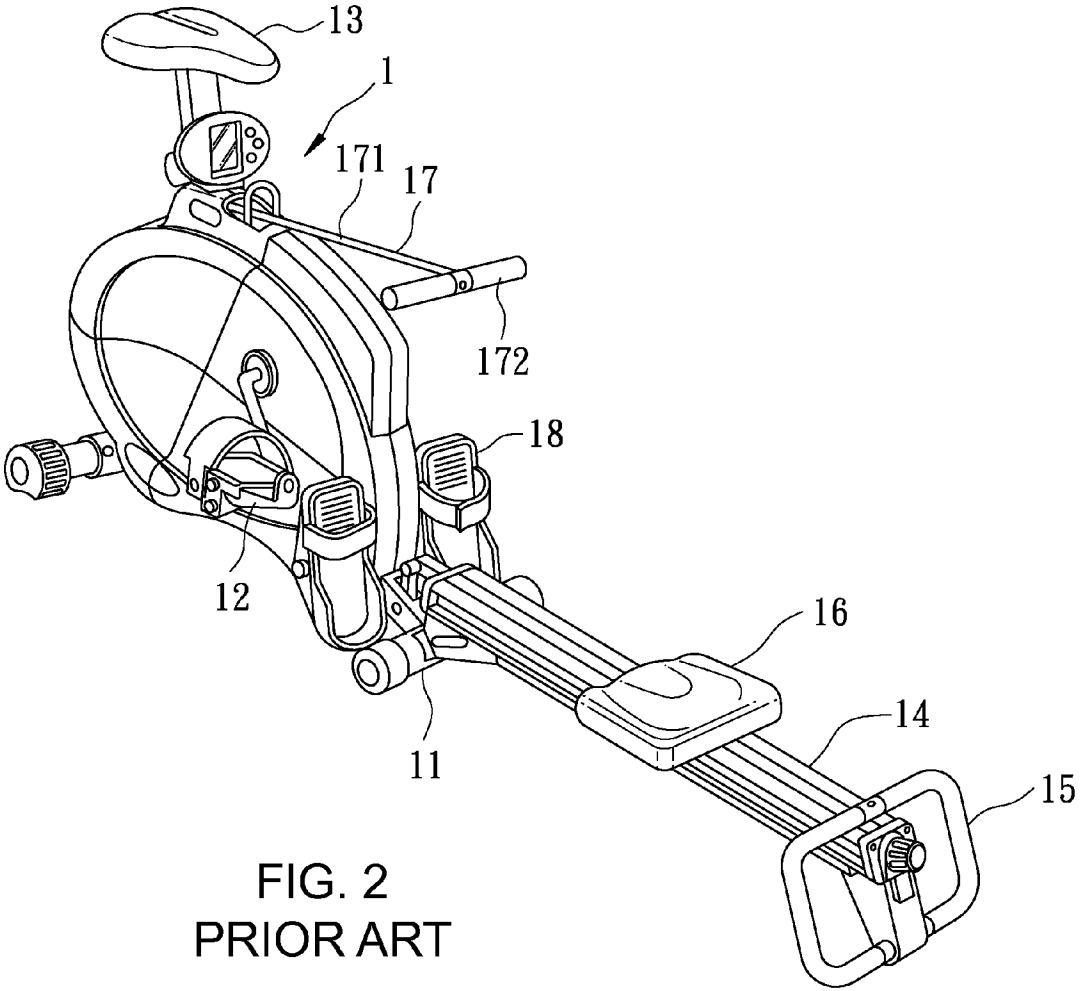
FIG. 2 PRIOR ART
FIG. 2 is another perspective view of the conventional exercise machine of FIG. 1, illustrating the arm changed from the vertical position to the horizontal position.

It should be noted that the drawing figures are not necessarily drawn to scale, but instead are drawn to provide a better understanding of the components thereof, and are not intended to be limiting in scope, but rather to provide exemplary illustrations. It should further be noted that the figures illustrate exemplary embodiments of a support frame for an exercise apparatus and the components thereof, and in no way limit the structures or configurations of a support frame for an exercise apparatus and components thereof according to the present disclosure.

DETAILED DESCRIPTION OF THE INVENTION

Other and further advantages and features of the present invention will be understood by reference to the following specification in conjunction with the accompanying drawings.

While the disclosure may be susceptible to various modifications and alternative constructions, certain illustrative embodiments are shown in the drawings and are described in detail below. It should be understood, however, that there is no intention to limit the disclosure to the specific embodiments disclosed, but on the contrary, the intention is to cover all modifications, alternative constructions, combinations, and equivalents falling within the spirit and scope of the disclosure.

It will be understood that, unless a term is expressly defined in this disclosure to possess a described meaning, there is no intent to limit the meaning of such term, either expressly or indirectly, beyond its plain or ordinary meaning.

Figure 3:
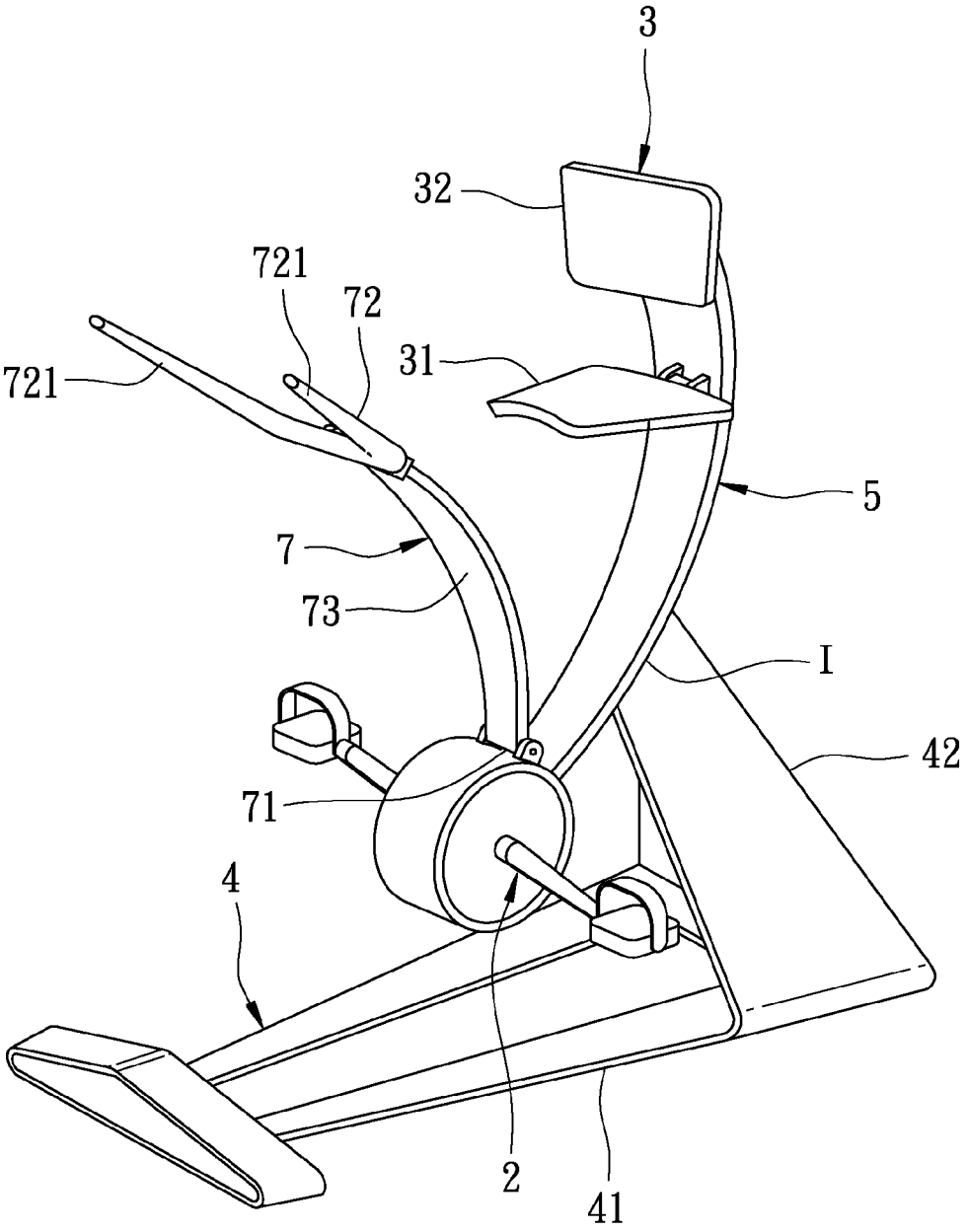
FIG. 3 is a perspective view illustrating a support frame used in an exercise apparatus in accordance with the present invention.
Figure 4:
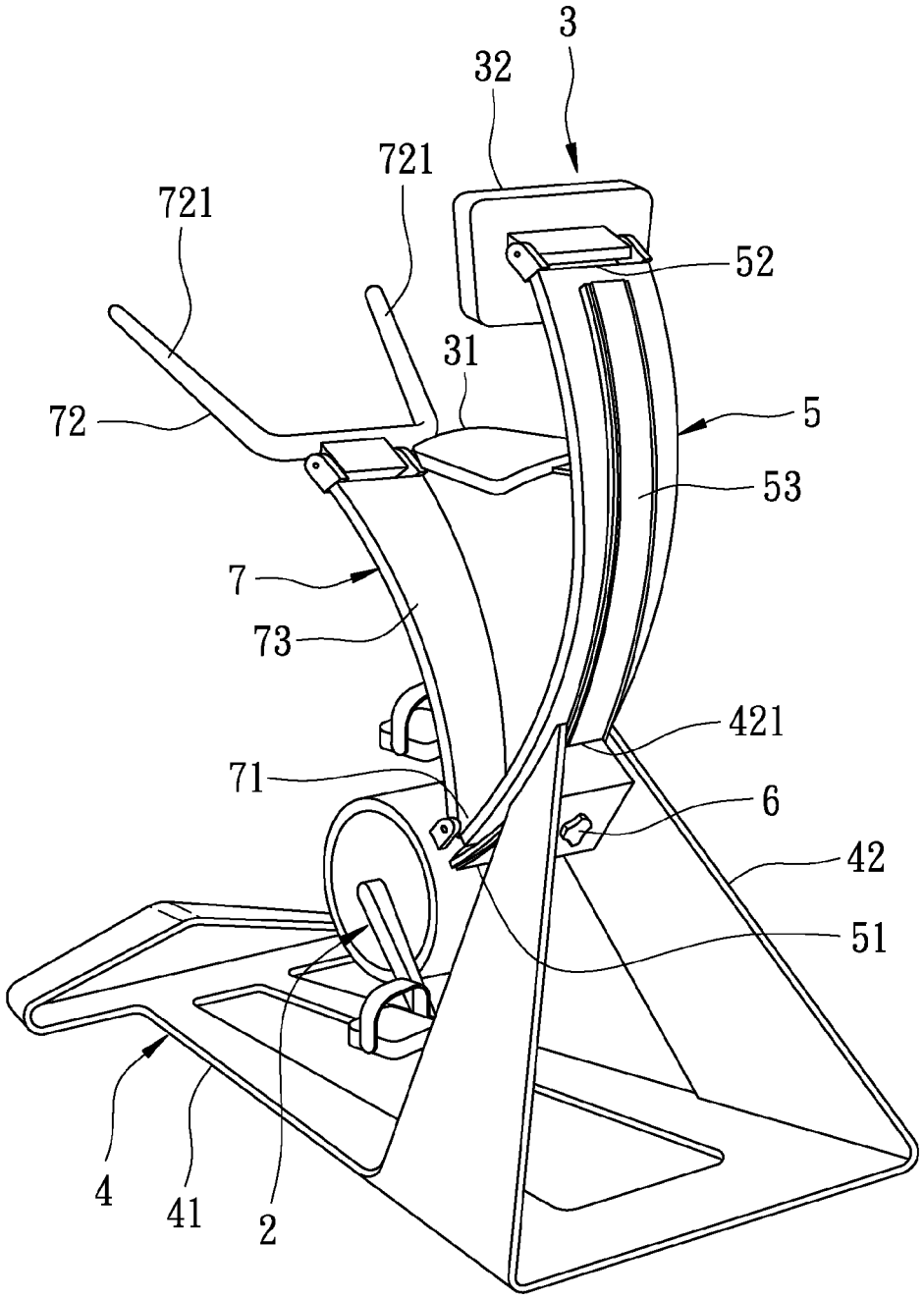
FIG. 4 is another perspective view of the exercise apparatus of FIG. 3, illustrating the increased elevation difference between the opposing first and second ends of the moving arm member in the vertical direction, and the decreased elevation difference between the opposing first and second ends of the moving arm member in the horizontal direction.

Referring to FIGS. 3 and 4, a support frame for an exercise apparatus in accordance with a preferred embodiment of the present invention is shown assembled with a wheel pedal unit 2 and a saddle unit 3. The wheel pedal unit 2 is configured for pedaling by the user's two legs. The saddle unit 3 comprises a saddle 31 and a back pad 32. The support frame comprises a base 4, a moving arm member 5, a locking member 6 and a handle assembly 7.

The base 4 comprises a body 41, and an upright 42 located at the body 41 and working as a fulcrum I. The upright 42 defines a sliding fitting portion 421 at the top side thereof. In this embodiment, the sliding fitting portion 421 is a sliding groove.

The moving arm member 5 is smoothly arched and slidably coupled to the upright 42 of the base 4. The moving arm member 5 comprises a first end 51 that is installed in the wheel pedal unit 2, an opposite second end 52 that is installed in the saddle unit 3, and a mating portion 53 located at the smoothly arched bottom side and extending along the length thereof. In this embodiment, the mating portion 53 is a smoothly arched rail slidably coupled to the sliding fitting portion 421 of the upright 42 of the base 4.

It is worth mentioning that the moving arm member 5 can be configured without the mating portion 53 such that it may be directly and slidably coupled to the sliding fitting portion 421. Further, the mating portion 53 can be a smoothly arched round tube configured to fit the substantially C-shaped sliding fitting portion 421. Alternatively, the upright 42 can be configured to provide one single sliding fitting portion 421 or two sliding fitting portions 421 at the top side thereof. Similarly, the mating portion 53 can be made in the form of a single round tube or dual round tube members for engaging the one single sliding fitting portion 421 or the two sliding fitting portions 421 of the upright 42, respectively.

The locking member 6 may preferably be a holding down screw threaded through the upright 42 and stopped against the moving arm member 5 to lock the moving arm member 5 to the upright 42 at a desired selected position.

The handle assembly 7 comprises a pivot portion 71 located at one end thereof, and pivotally coupled to the first end 51 of the moving arm member 5. The handle assembly 7 also comprises a handlebar 72 located at an opposite end thereof for holding by the user, and an arched connection bar 73 connected between the pivot portion 71 and the handlebar 72. It should be appreciated that the arched connection bar 73 is configured to fit with the moving arm member 5. For example, the arched connection bar may be configured to lie flush against the moving arm member. The handlebar 72 comprises two grips 721 located at two distal ends thereof and spaced from each other at a distance larger than the width of the saddle 31.

Figure 5:
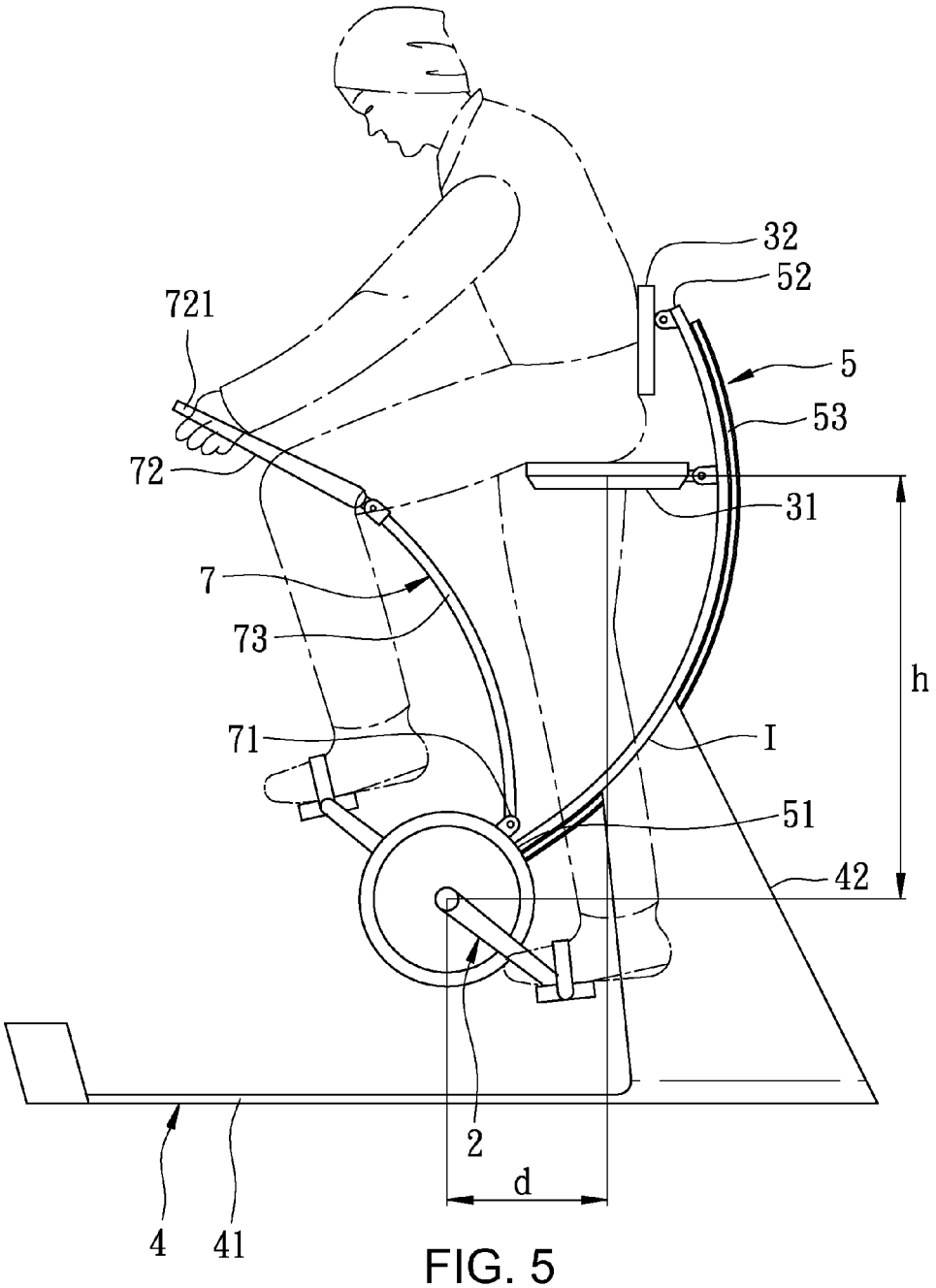
FIG. 5 is a schematic front view of the exercise apparatus of FIG. 3, illustrating a user sitting on the saddle unit in the normal sitting position.

During operation, the handle assembly 7 can be moved back and forth between a first position where the arched connection bar 73 is matingly attached to the moving arm member 5 such that it lies substantially flush against the moving arm member (see FIGS. 6 and 7), and a second position where the arched connection bar 73 is spaced apart from the moving arm member 5 at a specified distance (see FIGS. 3 through 5). Further, when the handle assembly 7 is in the first position with the arched connection bar 73 matingly attached to the moving arm member 5, the vertically extending handlebar 72 does not extend past the saddle unit 3.

Referring to FIGS. 3 through 5 again, when the mating portion 53 of the moving arm member 5 is moved along the sliding fitting portion 421 of the upright 42 to the position where the first end 51 is kept in proximity to the upright 42, the elevation difference h in the vertical direction between the first end 51 and the second end 52, as well as between the wheel pedal unit 2 at the first end 51 and the saddle unit 3 at the second end 52, is maximized. Further, the elevation difference d in the horizontal direction is correspondingly minimized. Thus, when the handle assembly 7 is adjusted to the second position, the user can sit on the saddle unit 3 in the normal upright, or elevated, sitting posture. Since the arched connection bar 71 holds the handlebar 72 far from the saddle unit 3 at this position, the user can hold the grips 721 with their hands in front of the saddle unit 3 to let their body correspondingly incline forward without pulling back the handle assembly 7. At this time, the user can pedal the wheel pedal unit 2 while it is located below the saddle unit 3.

Figure 6:
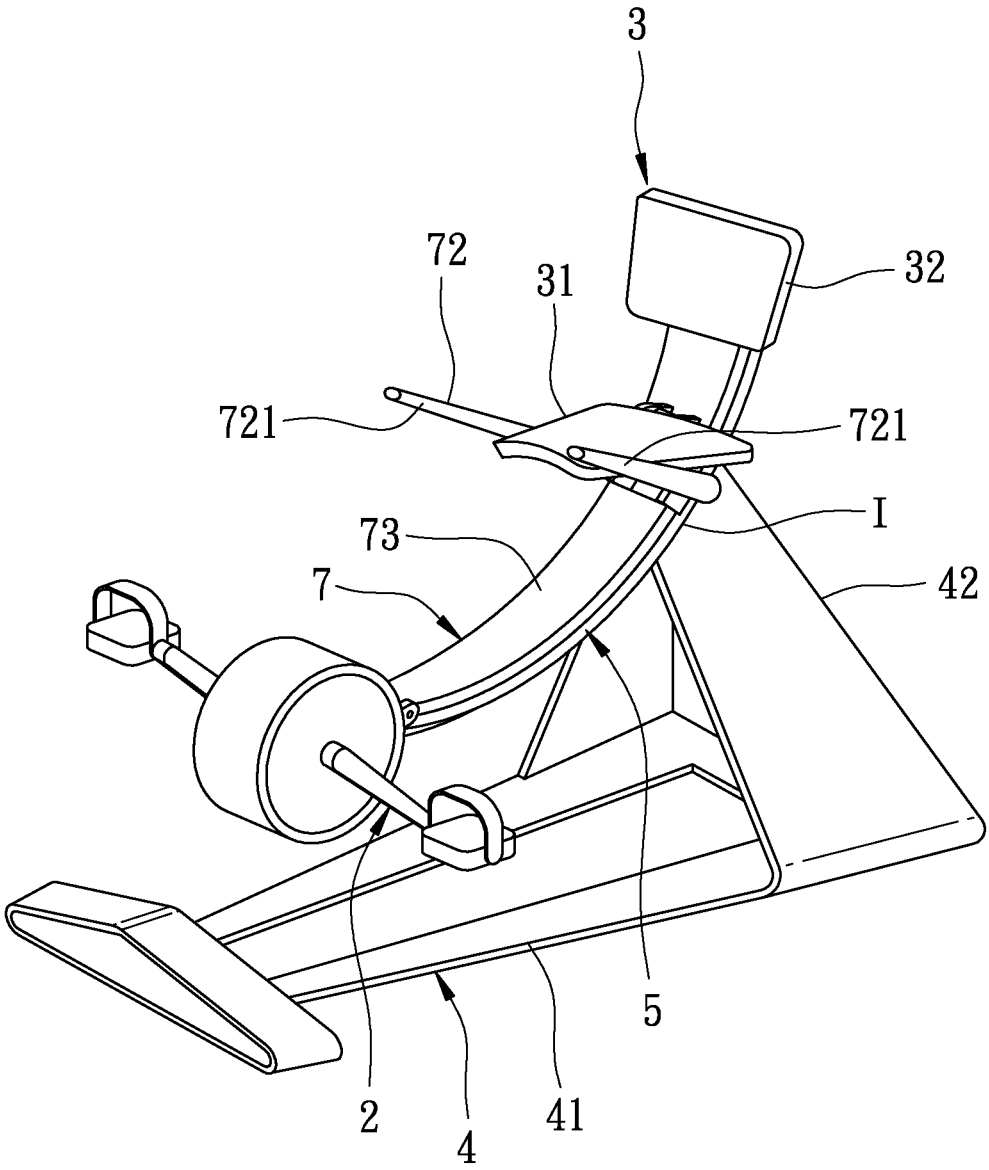
FIG. 6 is a perspective view of the exercise apparatus of the present invention, illustrating the reduced difference in elevation between the opposing first and second ends of the moving arm member in the vertical direction, and the increased elevation difference between the opposing first and second ends of the moving arm member in the horizontal direction.
Figure 7:
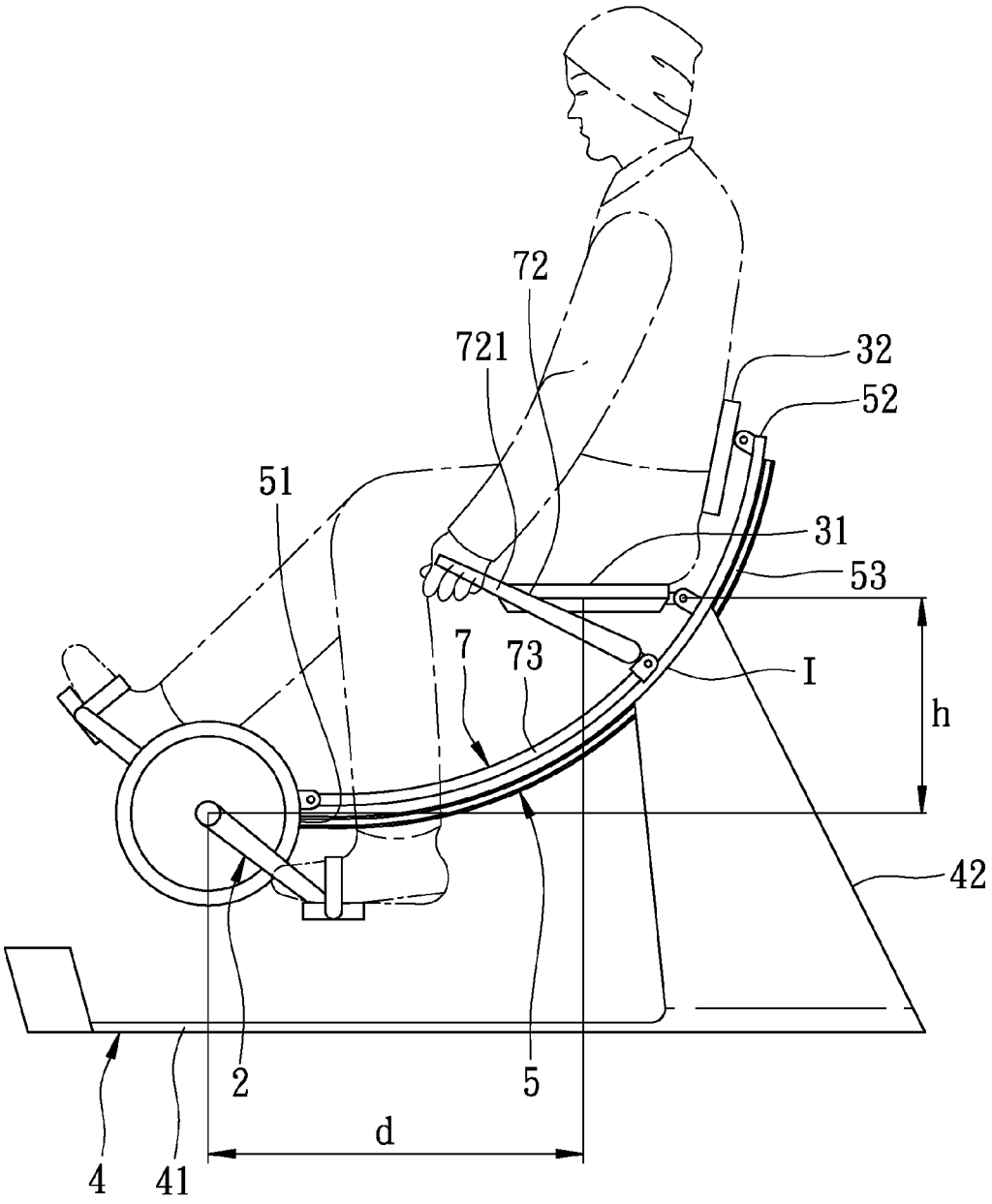
FIG. 7 is a schematic front view of the exercise apparatus of FIG. 6, illustrating a user sitting on the saddle unit in the recumbent sitting position.

Referring to FIGS. 6 and 7, when the mating portion 53 of the moving arm member 5 is moved along the sliding fitting portion 421 of the upright 42 to the position where the second end 51 is kept in proximity to the upright 42, the elevation difference h between the first end 51 and the second end 52 in the vertical direction, as well as between the wheel pedal unit 2 at the first end 51 and the saddle unit 3 at the second end 52, is minimized. Further, the elevation difference d in the horizontal direction is correspondingly maximized. Thus, when the handle assembly 7 is adjusted to the first position, the user can sit on the saddle unit 3 in a recumbent posture. Since the gap between the grips 721 is larger than the width of the saddle 31, and since the handlebar 72 does not extend past the saddle unit 3 in the vertical direction, the user can hold the grips 721 with their hands at two opposite lateral sides relative to the saddle unit 3. Thus the user can pedal the wheel pedal unit 2 while it is located in front of the saddle unit 3.

It is therefore apparent that the support frame for an exercise apparatus as described herein has many benefits. The relative position between the wheel pedal unit 2 and the saddle unit 3 may be relatively changed by moving the moving arm member 5 to change the elevation difference d in the horizontal direction and the elevation difference h in the vertical direction between the first end 51 and the second end 52. This also allows the user to sit on the saddle in a normal upright, or elevated, sitting position or an alternative recumbent sitting position in order to perform different exercises. Thus, the simplified structure of the exercise apparatus support frame of the present invention has enhanced practicality since it facilitates operation by advantageously incorporating only one single wheel pedal unit 2 and one single saddle unit 3 for performing different exercise modes.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A support frame mounted in an exercise apparatus comprising a wheel pedal unit for pedaling by the legs of a user and a saddle unit for the sitting of the user using the exercise apparatus, the support frame comprising:

a base; and a moving arm member being smoothly arched and slidably coupled to said base, said moving arm member comprising a first end connected to said wheel pedal unit and an opposite second end connected to said saddle unit, a distance difference between said first and second ends in the vertical and horizontal directions being changeable subject to changing the relative position between said moving arm member and said base.

2. The support frame for an exercise apparatus according to claim 1, wherein said base comprises a body, and an upright located at said body to work as a fulcrum for supporting said moving arm member, said upright comprising a sliding fitting portion at a top side thereof.

3. The support frame for an exercise apparatus according to claim 2, wherein said moving arm member comprises a smoothly arched mating portion located at a bottom side thereof and slidably coupled to said sliding fitting portion of said upright.

4. The support frame for an exercise apparatus according to claim 3, wherein said sliding fitting portion is a sliding groove, and said mating portion is a corresponding sliding rail.

5. The support frame for an exercise apparatus according to claim 3, wherein when said saddle unit is moved with said second end of said moving arm member in a direction away from said upright, the distance difference between said first and second ends in the vertical direction is maximized, and the distance difference between said first and second ends in the horizontal direction is minimized.

6. The support frame for an exercise apparatus according to claim 5, wherein when said saddle unit is moved with said second end of said moving arm member in a direction toward said upright, the distance difference between said first and second ends in the vertical direction is minimized, and the distance difference between said first and second ends in the horizontal direction is maximized.

7. The support frame for an exercise apparatus according to claim 3, further comprising a locking member mounted in said upright and adapted to lock said moving arm member to said upright.

8. The support frame for an exercise apparatus according to claim 7, wherein said locking member is a holding down screw threaded through said upright and stopped against said moving arm member.

9. The support frame for an exercise apparatus according to claim 1, further comprising a handle assembly having an arched connection bar, the handle assembly pivotally mounted at said moving arm member and movable back and forth between a first position where said handle assembly is attached to said moving arm member and a second position where said arched connection bar is kept spaced apart from said moving arm member.

10. The support frame for an exercise apparatus according to claim 9, wherein the arched connection bar is matingly attached to the moving arm member such that it lies substantially flush against the moving arm member when in the first position.

11. The support frame for an exercise apparatus according to claim 9, wherein said handle assembly comprises a pivot portion located at one end thereof and pivotally coupled to said first end of said moving arm member, a handlebar located at an opposite end thereof for holding by a user, and wherein the arched connection bar is connected between said pivot portion and said handlebar and configured to matingly fit with said moving arm member.

12. The support frame for an exercise apparatus according to claim 11, wherein said arched connection bar is further configured to lie substantially flush with said moving arm member when in the first position.

13. The support frame for an exercise apparatus as claimed in claim 11, wherein said handlebar of said handle assembly comprises two grips located at two distal ends thereof and spaced from each other at a distance larger than the width of said saddle unit so that said two grips are respectively located at two opposite lateral sides relative to said saddle unit when said handle assembly is in said first position.

14. The support frame for an exercise apparatus as claimed in claim 11, wherein said arched connection bar holds said handlebar far away from said saddle unit when said handle assembly is in said second position.

15. A support frame mounted in an exercise apparatus comprising a wheel pedal unit for pedaling and a saddle unit for sitting, the support frame comprising:

a base having a body and an upright;

a moving arm member being smoothly arched and slidably coupled to said base, said moving arm member comprising a first end connected to said wheel pedal unit and an opposite second end connected to said saddle unit, a distance difference between said first and second ends in the vertical and horizontal directions being changeable subject to changing the relative position between said moving arm member and said base; and wherein said upright is located at said body to work as a fulcrum for supporting said moving arm member, said upright comprising a sliding fitting portion at a top side thereof.

16. The support frame for an exercise apparatus according to claim 15, wherein said moving arm member comprises a smoothly arched mating portion located at a bottom side thereof and slidably coupled to said sliding fitting portion of said upright.

17. The support frame for an exercise apparatus according to claim 16, further comprising a handle assembly having a pivot portion located at one end thereof and pivotally coupled to said first end of said moving arm member, a handlebar located at an opposite end thereof for holding by a user, and an arched connection bar located between the pivot portion and the handlebar.

18. The support frame for an exercise apparatus according to claim 17, wherein the handle assembly is movable back and forth between a first position where said handle assembly engages said moving arm member, and a second position where said arched connection bar is spaced apart from said moving arm member, and wherein the arched connection bar engages the moving arm member such that it lies substantially flush against the moving arm member when in the first position.

19. A support frame mounted in an exercise apparatus comprising a wheel pedal unit for pedaling and a saddle unit for sitting, the support frame comprising:

a base having a body and an upright, said upright comprising a sliding fitting portion at a top side thereof;

a moving arm member being smoothly arched and slidably coupled to said base, said moving arm member comprising a first end connected to said wheel pedal unit and an opposite second end connected to said saddle unit, a distance difference between said first and second ends in the vertical and horizontal directions being changeable subject to changing the relative position between said moving arm member and said base, wherein said moving arm member further comprises a smoothly arched mating portion located at a bottom side thereof and slidably coupled to said sliding fitting portion of said upright; and wherein said upright is located at said body to work as a fulcrum for supporting said moving arm member.

20. The support frame for an exercise apparatus according to claim 3, wherein when said saddle unit is moved with said second end of said moving arm member in a direction away from said upright, the distance difference between said first and second ends in the vertical direction is maximized, and the distance difference between said first and second ends in the horizontal direction is minimized; and wherein when said saddle unit is moved with said second end of said moving arm member in a direction toward said upright, the distance difference between said first and second ends in the vertical direction is minimized, and the distance difference between said first and second ends in the horizontal direction is maximized.

* * * * *